US006164504A

United States Patent [19]

Richard

[11] Patent Number: 6,164,504

[45] Date of Patent: Dec. 26, 2000

[54] CLOTHES HANGER EXTENDER

[76] Inventor: Michael J. Richard, 566 Wylie Dr., Baton Rouge, La. 70821

[21] Appl. No.: 09/303,482

[22] Filed: Apr. 30, 1999

[51] Int. Cl.[7] ..... A47G 25/44

[52] U.S. Cl. ..... 223/94; 223/89

[58] Field of Search ..... 223/94, 92, 85, 223/89, 88

[56] References Cited

U.S. PATENT DOCUMENTS

| | | | |
|---|---|---|---|
| 2,335,285 | 11/1943 | Kinney . | |
| 2,538,971 | 1/1951 | Leumi . | |
| 2,582,669 | 1/1952 | Battle . | |
| 2,620,102 | 12/1952 | Bremer | 223/89 |
| 2,819,828 | 1/1958 | Thurber . | |
| 2,884,171 | 4/1959 | Knuth . | |
| 3,005,579 | 10/1961 | Thurber . | |
| 3,039,662 | 6/1962 | Strong . | |
| 4,905,877 | 3/1990 | Gatling | 223/90 |
| 5,052,599 | 10/1991 | Platti | 223/94 |
| 5,082,152 | 1/1992 | Chen . | |
| 5,085,352 | 2/1992 | Lam . | |
| 5,085,358 | 2/1992 | Lam | 223/89 |
| 5,344,054 | 9/1994 | Nutter | 223/89 |
| 5,476,199 | 12/1995 | Halverson et al. . | |

FOREIGN PATENT DOCUMENTS 2 586 919 10/1996 France .

*Primary Examiner*—Bibhu Mohanty

*Attorney, Agent, or Firm*—Kean, Miller, Hawthorne, D'Armond, McCowan & Jarman, L.L.P.; Russel O. Primeaux

[57] ABSTRACT

A clothes hanger extender which attaches to standard plastic clothes hanger so as to be able to adjust for different sized garments. The channel end has a hollow interior with a substantially elliptical cross section. The first portion of the channel, the channel locking portion, has a locking portion width which is smaller than the channel end's interior diameter. The second portion of the channel, the channel transition portion, connects the channel locking portion with the channel adjustment portion to make a continuous channel. The last portion of the channel is the channel adjustment portion. The channel adjustment portion allows the clothes hanger extender to slide over a standard plastic clothes hanger. The channel adjustment portion alternatively terminates at the shoulder end, or is the shoulder end, depending upon whether the shoulder end is a separate component. The entire channel is formed by a material which is sufficiently elastic to allow the channel to be expanded from the locking portion width to the interior diameter without permanently deforming the material.

12 Claims, 3 Drawing Sheets

CLOTHES HANGER EXTENDER

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

This invention relates, generally, to adjustable clothes hangers for hanging clothes of various sizes.

2. Description of Related Art

Clothes hangers, also called garment hangers, coat hangers, or just hangers, have long been known in the art. Hangers can be constructed from metal wire, wood, plastic or a combination of these materials. Commercially available hangers are a fixed length and cannot be adjusted for garments of different sizes.

Shirts, jackets, sweaters, coats, blouses and certain dresses all have seams which connect the sleeves to the torso portion of the garment. A hanger of incorrect length terminates either on the shoulder or on the sleeve, leaving unsightly wrinkles and stretch marks. A hanger of proper length terminates at the seam, a reinforced portion of the garment, thereby preventing any wrinkles or stretch marks.

Although fixed length hangers may be the proper size for some articles of clothing, very few garments have seams in the same place. It is therefore desirable to have an adjustable length hanger. Additionally, fixed length hangers may be too small for garments with wide neck openings.

Patents have been granted to several designs which attempt to solve the problem of fixed length hangers. The majority of these patents are to designs which require fabrication of an entire hanger. For example, U.S. Pat. No. 5,085,358 to Lam describes an extendable arm which is pivotally mounted to engage and disengage the support arm of the hanger. U.S. Pat. No. 5,476,199 to Halverson describes an extendable arm and a support arm which are slidably engaged with each other through gripping members.

A major problem with these designs is the cost involved in producing the hangers. A typical plastic hanger is injection-molded and can be mass-produced at a very low cost. The prior art designs are complex and cost much more than standard fixed length hangers to produce.

U.S. Pat. No. 2,335,285 to Kinney teaches a complex design which allows adjustable hinged shoulder supports to lock onto a base which is attached to a metal wire hanger. Although the invention uses a pre-existing hanger, it is far too complex to be produced cheaply.

U.S. Pat. No. 2,884,171 to Knuth teaches a simpler pressure-mounted cardboard design, but is intended for wire hangers and still requires expensive fabrication.

What is needed is a clothes hanger extender which overcomes the shortfalls of the devices which are currently known in the art.

OBJECTS OF THE INVENTION

It is an object of the present invention to provide a clothes hanger extender which can adjust to variable sizes of clothing.

It is another object of the present invention to provide a clothes hanger extender which can easily attach to commercially available clothing hangers.

It is another object of the present invention to provide a clothes hanger extender which can be cheaply produced.

SUMMARY OF THE INVENTION

A clothes hanger extender is provided. The clothes hanger extender comprises a channel end and the front and may have a shoulder end at the back. The channel end has a hollow interior with a substantially elliptical cross-section. The substantially elliptical cross section has an interior diameter. The continuous channel in the channel end comprises three sections, the channel locking portion, the channel transition portion and the channel adjustment portion. The channel locking portion of the channel is located at the locking portion bottom, which is below and parallel to the axis from which the interior diameter is measured. The channel locking portion begins at the front of the clothes hanger extender and ends at the channel transition portion. The width of the channel at the channel locking portion, the channel locking portion width, is less than the interior diameter. The channel transition portion connects the channel locking portion with the channel adjustment portion. The channel adjustment portion alternatively terminates at the shoulder end, or is the shoulder end, depending upon whether the clothes hanger extender has a shoulder end. The channel adjustment portion is located at the adjustment portion bottom. The entire channel is formed by a material which is sufficiently elastic to allow the channel to be expanded from the locking portion width to the interior diameter without permanently deforming said material.

An advantage of the invention is that the clothes hanger extender can adjust to variable sizes of clothing.

A further advantage of the invention is that the clothes hanger extender can easily attach to commercially available clothing hangers.

A further advantage of the invention is that the clothes hanger extender can be cheaply produced.

It is a feature of the invention that the transition from the clothing hanger to the clothes hanger extender is smooth and does not create a crease at the transition point.

These and other objects, advantages, and features of this invention will be apparent from the following description.

DETAILED DESCRIPTION OF THE INVENTION

Figure 1:
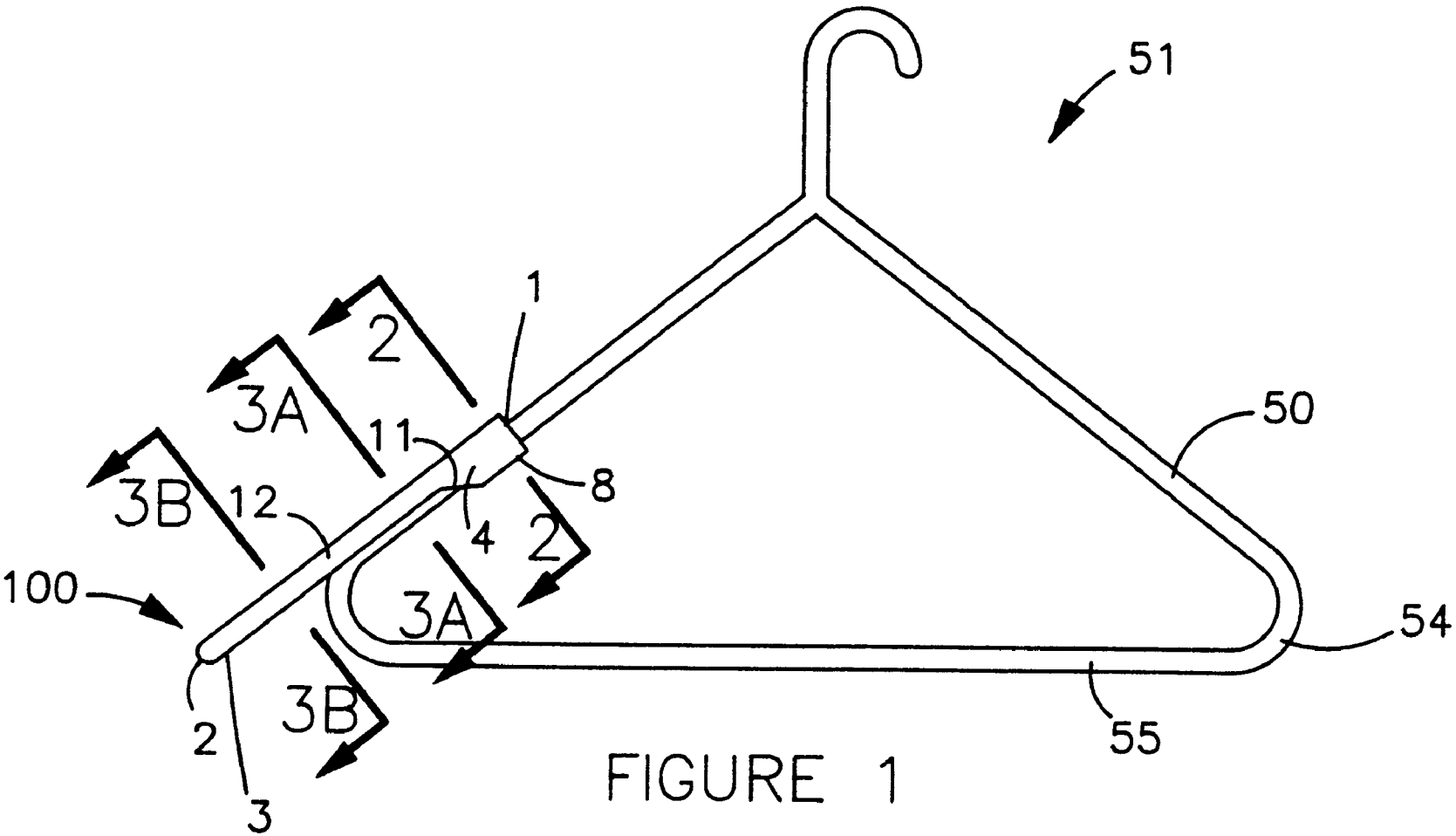
FIG. 1 is a side view of a preferred embodiment of the invention attached to a standard plastic clothes hanger.

Referring to FIGS. 1, 2, 3A and 3B, clothes hanger extender 100 attaches to arm 50 of standard plastic clothes hanger 51. Clothes hanger extender 100 has a front portion 1, and a back portion 2. Shoulder end 3 is located at back portion 2 of clothes hanger extender 100, and channel end 4 is located at front portion 1 of clothes hanger extender 100.

Clothes hanger extender 100 slides up and down arm 50, so as to adjust to different sized garments. Clothes hanger extender 100 is hollow so it can fit around arm 50 and has channel 5 running the length of channel end 4 portion of clothes hanger extender 100.

Figure 2:
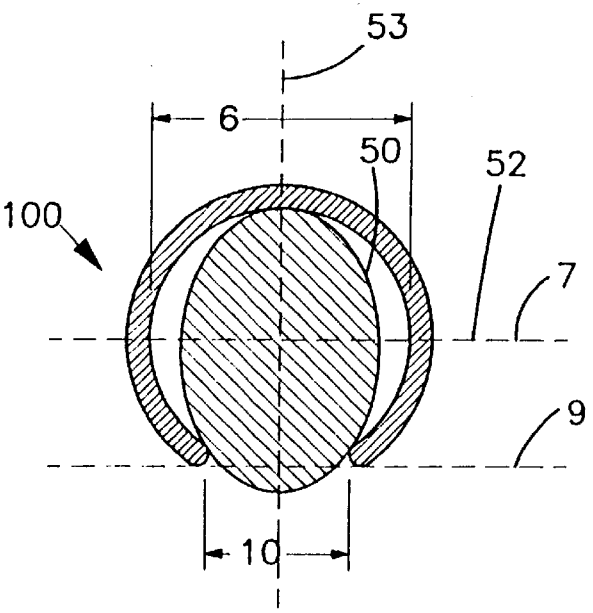
FIG. 2 is a cross section of a preferred embodiment of the invention attached to a standard plastic clothes hanger.
Figure 3A:
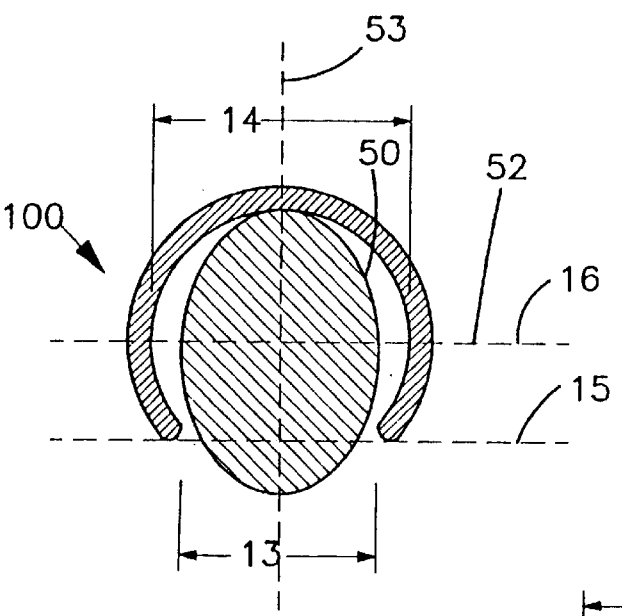
FIG. 3A is a cross section of a preferred embodiment of the invention attached to a standard plastic clothes hanger.

As seen in FIGS. 2 and 3A, the cross-section of arm 50 is substantially elliptical in shape. One common commercially available hanger has arm 50 cross-sections which have a width approximately 0.28 inches along first axis 52, and a length approximately 0.31 inches along second axis 53. Depending on the specific manufacture and brand of standard plastic clothes hanger 51, the dimensions of the cross-section will slightly differ. As used herein, the term substantially elliptical includes ellipses where width of arm 50 along first axis 52 can be either larger or smaller than length of arm 50 along second axis 53, ellipses where interior width of arm 50 along first axis 52 is equal to length of arm along second axis 53 (i.e., a circle), and ellipses where either first axis 52 or second axis 53 is slightly off-center.

The tolerance between arm 50 cross-section and clothes hanger extender 100 does not have to be exact. A substantially elliptical cross-section of clothes hanger extender 100 will work on a substantially elliptical arm 50 cross section even if the exact measurements do not match. Interior diameter 6 of clothes hanger extender 100 is shown in FIG. 2 and is measured along axis 7. Although FIG. 2 shows first axis 52 coinciding with axis 7, such a configuration is only one embodiment of the invention. The inventor has been successful using an interior diameter 6 of about 0.32 inches with a clothes hanger extender 100 that has a circular cross-section on standard plastic clothes hanger 51 with the dimensions described above.

Figures 4, 5:
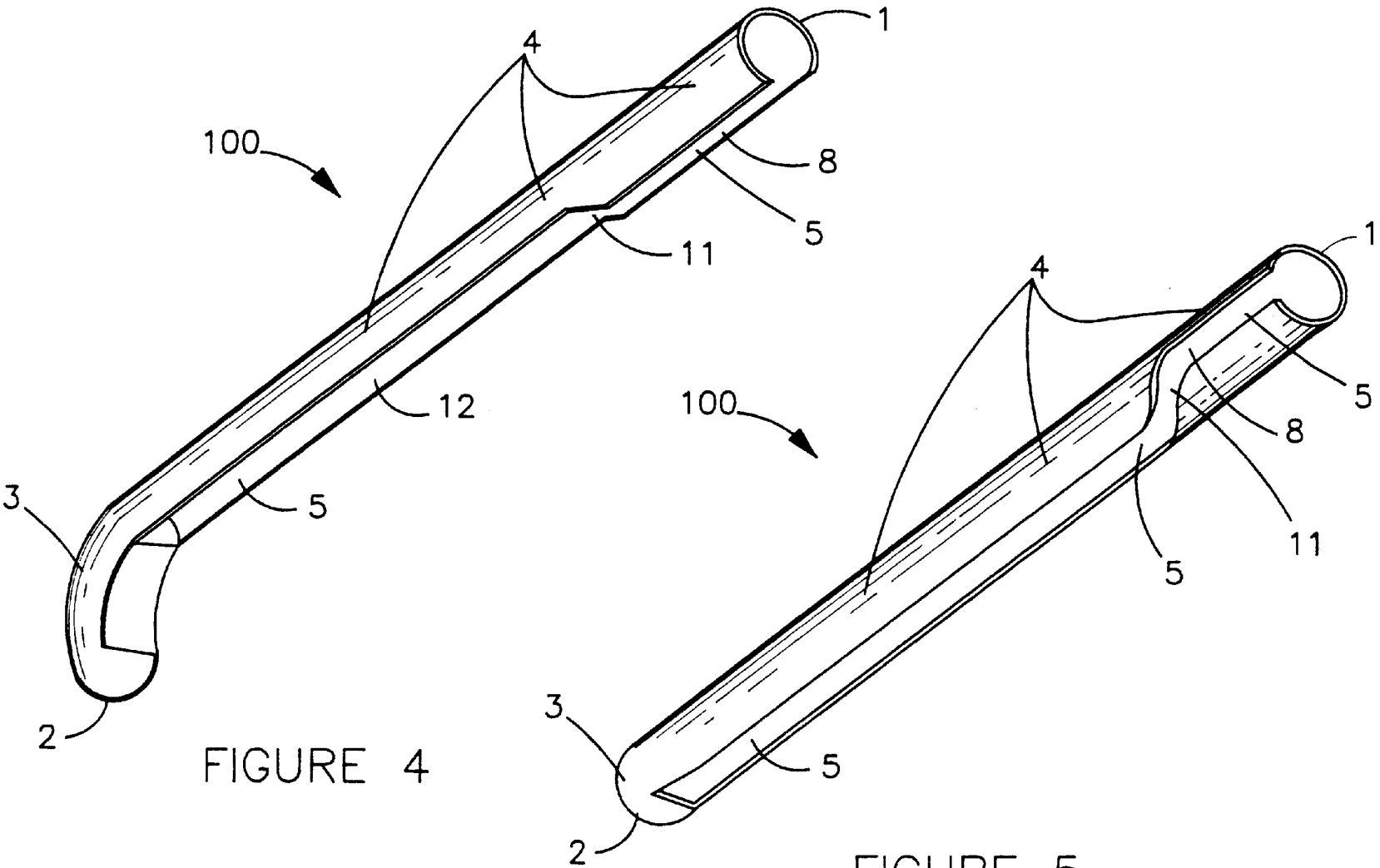
FIG. 4 is a perspective view of a preferred embodiment of the invention.
FIG. 5 is a perspective view of a preferred embodiment of the invention.

As seen in FIGS. 4 and 5, channel 5 runs the length of channel end 4 comprises at least three sections. The first section of channel 5, channel locking portion 8, is located at front portion 1 of clothes hanger extender 100 on the locking portion bottom 9. Locking portion bottom 9 is parallel to axis 7.

Channel locking portion 8 must have a width 7 less than interior diameter 6 and be located below axis 7. This is necessary because it is primarily channel locking portion 8 which prevents clothes hanger extender 100 from falling off standard plastic clothes hanger 51. Channel locking portion width 10 is shown on FIG. 2. Although a narrower channel locking portion width 10 is desirable so that clothes hanger extender 100 will properly grip arm 50, it should not be so small to make it difficult to attach and remove clothes hanger extender 100 from standard plastic clothes hanger 51. The inventor has found that a channel locking portion width 10 of about 0.18 inches accomplishes these goals for standard plastic clothes hanger 51 with the dimensions described above.

Channel end 4 must be formed of a material which is sufficiently elastic to allow channel 5 to be expanded from channel locking portion width 10 to interior diameter 6. This is necessary so clothes hanger extender 100 can be attached and removed from standard plastic clothes hanger 51. If the material were too brittle, the clothes hanger extender 100 would break when attached to arm 50. If the material underwent significant plastic deformation, it would not keep clothes hanger extender 100 in place. Materials which undergo small amounts of plastic deformation would still be sufficiently elastic to allow clothes hanger extender 100 to work properly. The inventor has found that Polypropylene is adequate for both its properties and low cost.

The second section of channel 5 is channel transition portion 11. Channel transition portion 11 merely serves to connect channel locking portion 8 and channel adjustment portion 12. Channel adjustment portion 12 of channel 5 is necessary to allow clothes hanger extender 100 to slide over arm 50 and hanger's bend 54 which connects arm 50 to base 55.

Figure 3B:
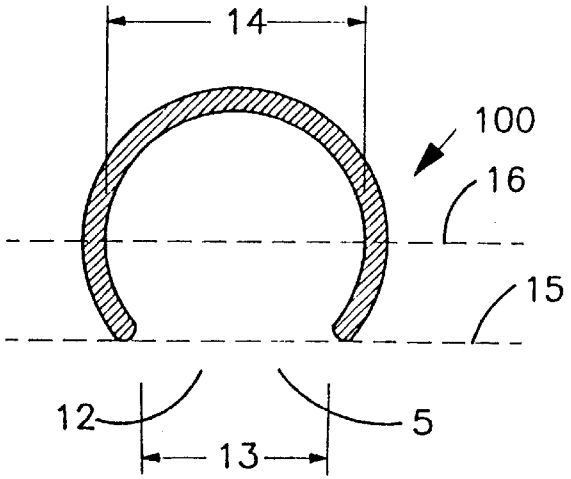
FIG. 3B is a cross section of a preferred embodiment of the invention.

FIGS. 3A and 3B show channel adjustment portion 12 with channel adjustment portion width 13 smaller than adjustment portion interior diameter 14, yet larger than channel locking portion width 10 (shown in FIG. 2). Channel adjustment portion width 13 can be almost any size and adjustment portion bottom 15 does not even have to be below adjustment portion axis 16. Adjustment portion axis 16 is analogous to axis 7; Adjustment portion axis 16 is parallel to adjustment portion bottom 15 and the adjustment portion interior diameter 14 is measured from the adjustment portion axis 16.

Although not required, it is preferable for adjustment portion bottom 15 to be below adjustment portion axis 16 and have a channel adjustment portion width 13 less than adjustment portion interior diameter 14, which is the embodiment shown in FIGS. 3A and 3B. More specifically, channel adjustment portion width 13 should be less then the width of arm 50 along first axis 52. In such a configuration channel adjustment portion 12 will grip hanger's bend 54 and provide extra stability to clothes hanger extender 100 by reducing rotation on arm 50. Depending on the material used, if channel adjustment portion width 13 is too small, it may be too difficult to slide clothes hanger extender 100 over hanger's bend 54. The inventor has found that a channel adjustment portion width 13 of about 0.27 inches accomplishes these goals for standard plastic clothes hanger 51 with the dimensions described above.

Sliding channel adjustment portion 12 over hanger's bend 54 forces clothes hanger extender 100 to stay in one direction relative to standard plastic clothes hanger 51. Channel adjustment portion 12, therefore, alternatively defines adjustment portion bottom 15 or is located at adjustment portion bottom 15.

Channel adjustment portion terminates at shoulder end 3. shoulder end 3 is the portion of clothes hanger extender 100 which is located at back portion 2 of the device. Various designs could be used with varying degrees of functionality. Although the straight designs of FIGS. 1 and 5 are easier to position at the seam of a sleeved garment, a design where shoulder end 3 is curved towards the adjustment portion bottom such as in FIG. 4 is more aesthetically pleasing.

Other shoulder end 3 designs can be contemplated such as where shoulder end 3 is adapted to elastically deform under the weight of a garment. If shoulder end 3 is made out of a flexible material, or if the thickness of shoulder end 3 varies such that it tapers away from channel adjustment portion 12, a garment will elastically deform shoulder end 3. This type of shoulder end 3 design will allow the garment to hang in a more natural manner and prevent wrinkles and stretch marks.

It is also possible to practice the invention without a separate shoulder end 3. The portion of clothes hanger extender 100 which contains channel adjustment portion 12 becomes shoulder end 3. In such a configuration, channel adjustment portion 12 terminates at the back of clothes hanger extender 100.

Another preferred embodiment is shown in FIG. 5. By offsetting locking portion bottom 9 and adjustment portion bottom 15, channel locking portion width 10 does not need to be as small as it does if both adjustment portion bottom 15 and locking portion bottom 9 are parallel to each other. The rotation prevents arm 50 from slipping through channel locking portion 8 when downward pressure is applied to shoulder end 3.

In the embodiment of FIG. 5, channel locking portion width 10 is not critical in keeping clothes hanger extender 100 on arm 50. Although channel locking portion width 10 should still be smaller than interior diameter 6, the clothes hanger extender 100 does not rely exclusively on channel locking portion width 10 to hold clothes hanger extender 100 in place. Almost any offset would be beneficial to prevent arm 50 from slipping through channel locking portion 8.

It should be noted that what interior diameter 6 is required will depend on the exact angle of rotation of the adjustment portion bottom from locking portion bottom 9. If locking portion bottom 9 is perpendicular to the adjustment portion bottom, then internal diameter 3 must be adapted to fit the length of arm 50 measured along second axis 53, as opposed to the width of arm 50 along first axis 52.

There are of course other alternate embodiments which are obvious from the foregoing descriptions of the invention, which are intended to be included within the scope of the invention, as defined by the following claims.

I claim:

1. A clothes hanger extender for fitting on an arm of a conventional hanger, said clothes hanger extender comprising:

(1) a front portion and a back portion opposite said front portion;

(2) a shoulder end located at said back portion;

(3) a channel end located at said front portion, said channel end comprising a locking portion bottom and an adjustment portion bottom;

(4) said channel end having a hollow interior with a substantially elliptical cross-section;

(5) said substantially elliptical cross-section having an axis parallel to said locking portion bottom and an interior diameter along said axis;

(6) a channel in said channel end, said channel comprising:

(a) a channel locking portion beginning at said front and having a channel locking portion width less than said interior diameter, said channel locking portion being located at said locking portion bottom and below said axis;

(b) a channel adjustment portion terminating at said shoulder end, said channel adjustment portion being located at said adjustment portion bottom; and (c) a channel transition portion connecting said channel locking portion with said channel adjustment portion; and (7) said channel being formed by a material which is sufficiently elastic to allow said channel to be expanded from said locking portion width to said interior diameter without permanently deforming said material so that said channel end of said front portion can grip said arm of said conventional hanger and so that said hanger extender can be selectively removed from and placed on said hanger arm.

2. The clothes hanger extender of claim 1 wherein said locking portion bottom and said adjustment portion bottom are parallel with each other.

3. The clothes hanger extender of claim 1 wherein said channel locking portion bottom and said channel adjustment portion bottom are not parallel with each other.

4. The clothes hanger extender of claim 2 wherein said channel adjustment portion has a channel adjustment portion width larger than said channel locking portion width and less than said interior diameter.

5. The clothes hanger extender of claim 3 wherein said channel adjustment portion has a channel adjustment portion width larger than said channel locking portion width and less than said interior diameter.

6. The clothes hanger extender of claim 2 wherein said shoulder end is curved towards said adjustment portion bottom.

7. The clothes hanger extender of claim 3 wherein said shoulder end is curved towards said adjustment portion bottom.

8. The clothes hanger extender of claim 2 wherein said shoulder end is adapted to elastically deform under the weight of a garment.

9. The clothes hanger extender of claim 3 wherein said shoulder end is adapted to elastically deform under the weight of a garment.

10. The clothes hanger extender of claim 2 wherein said substantially elliptical cross-section is a circular cross-section.

11. The clothes hanger extender of claim 3 wherein said substantially elliptical cross-section is a circular cross-section.

12. A clothes hanger extender for fitting on an arm of a conventional hanger, said clothes hanger extender comprising:

(1) a channel end, said channel end comprising a front and a back, a locking portion bottom and an adjustment portion bottom;

(2) said channel end having a hollow interior with a substantially elliptical cross-section;

(3) said substantially elliptical cross-section having an axis parallel to said locking portion bottom and an interior diameter along said axis;

(4) a channel in said channel end, said channel comprising:

(a) a channel locking portion beginning at said front and having a channel locking portion width less than said interior diameter, said channel locking portion being located at said locking portion bottom and below said axis;

(b) a channel adjustment portion terminating at said back, said channel adjustment portion being located at said adjustment portion bottom; and (c) a channel transition portion connecting said channel locking portion with said channel adjustment portion; and (5) said channel being formed by a material which is sufficiently elastic to allow said channel to be expanded from said locking portion width to said interior diameter without permanently deforming said material so that said channel end can grip said arm of said conventional hanger and so that said hanger extender can be selectively removed from and placed on said hanger arm.

* * * * *